US008926350B2

(12) United States Patent
Wolfe et al.

(10) Patent No.: US 8,926,350 B2
(45) Date of Patent: Jan. 6, 2015

(54) PROTECTIVE LOCKABLE FEMALE ELECTRICAL OUTLET

(71) Applicants: Shawn M. Wolfe, Cedar Rapids, IA (US); Nicholas P. Wolfe, Cedar Rapids, IA (US)

(72) Inventors: Shawn M. Wolfe, Cedar Rapids, IA (US); Nicholas P. Wolfe, Cedar Rapids, IA (US)

( * ) Notice: Subject to any disclaimer, the term of this patent is extended or adjusted under 35 U.S.C. 154(b) by 50 days.

(21) Appl. No.: 13/895,477

(22) Filed: May 16, 2013

(65) Prior Publication Data

US 2013/0309883 A1 Nov. 21, 2013

Related U.S. Application Data

(60) Provisional application No. 61/648,445, filed on May 17, 2012.

(51) Int. Cl.

| | |
|---|---|
| ***H01R 29/00*** | (2006.01) |
| ***H01R 13/58*** | (2006.01) |
| ***H01R 13/62*** | (2006.01) |
| ***H01R 13/71*** | (2006.01) |
| *H01R 24/78* | (2011.01) |

(52) U.S. Cl.

CPC ..... *H01R 13/58* (2013.01); *H01R 13/62* (2013.01); *H01R 13/71* (2013.01); *H01R 24/78* (2013.01)

USPC ..... 439/188

(58) Field of Classification Search

USPC ..... 439/188, 346

See application file for complete search history.

(56) References Cited

U.S. PATENT DOCUMENTS

| | | | | |
|---|---|---|---|---|
| 5,256,376 | A * | 10/1993 | Callan et al. | 422/72 |
| 5,286,213 | A | 2/1994 | Altergott et al. | |
| 5,413,498 | A | 5/1995 | Ursich | |
| 5,551,884 | A | 9/1996 | Burkhart, Sr. | |
| 5,791,931 | A | 8/1998 | Burkhart, Sr. | |
| 5,795,168 | A | 8/1998 | Duhe | |
| 5,921,799 | A | 7/1999 | Forrester | |
| 5,984,700 | A | 11/1999 | Chang | |
| 6,193,539 | B1 | 2/2001 | Chang | |
| 6,234,824 | B1 | 5/2001 | Chang | |
| 6,332,794 | B1 | 12/2001 | Tzeng Jeng | |
| 6,846,206 | B2 | 1/2005 | Kling et al. | |
| 7,083,458 | B1 | 8/2006 | Chang | |
| 7,114,979 | B1 | 10/2006 | Lai | |
| 7,232,349 | B1 | 6/2007 | Chen | |
| 7,361,045 | B1 | 4/2008 | Vinciguerra et al. | |
| 7,484,986 | B1 | 2/2009 | Wu | |
| 7,497,705 | B2 | 3/2009 | Larson et al. | |
| 8,472,152 | B2 * | 6/2013 | Ford et al. | 361/2 |

* cited by examiner

*Primary Examiner* — Phuong Dinh

(74) *Attorney, Agent, or Firm* — Brett D. Papendick; Shuttleworth & Ingersoll, PLC

(57) ABSTRACT

An improved electrical outlet providing a lockable electrical connection between a male plug and the outlet to securely retain the plug. The method to secure and retain the plug imparts minimal stress to the outlet and to the male plug so as to not substantially decrease the durability of either. The outlet decreases the shocking potential to a user or unwitting child by remaining un-energized when idle, and prohibits movement from its idle position until the outlet has received the plug terminal prongs. The shape of the movable receptacle assembly and its corresponding cavity blocks a child from contacting the outlets power source with a metallic object, while making the power source available to the receptacle assembly when initiated by the user. The outlets locking action steps secure and energize the plug simultaneously during the locking action steps in a user friendly manner. The modularized design of the receptacle module can provide an easily adaptable means to fit and form various arrangements such as a wall outlet or an extension cord outlet.

15 Claims, 11 Drawing Sheets

PROTECTIVE LOCKABLE FEMALE ELECTRICAL OUTLET

CROSS-REFERENCE TO RELATED APPLICATIONS

This application claims the benefit of provisional patent application Ser. No. 61/648,445, filed May 17, 2012 by the present inventors.

FEDERALLY SPONSORED RESEARCH

Not Applicable

SEQUENCE LISTING OR PROGRAM

Not Applicable

BACKGROUND OF THE INVENTION

1. Field of Invention

This invention relates to electrical receptacles, and in particular to a protective electrical receptacle having a releasable locking mechanism to secure the plug's terminal prongs within the outlet.

2. Prior Art

A wide variety of electrical receptacles are known to provide electrical connection between male electrical connectors having blade type terminal prongs, commonly referred to as plugs, and female receptacles for receiving the plug's terminal prongs, commonly referred to as outlets.

The most common outlet has a pair of electrical contacts that receive the plug's terminal prongs. The contacts are biased into contact with the prongs, the biasing force of the electrical contacts against the prongs is relatively light and the plug is easily inserted or removed from the outlet. The low withdrawal force creates an inconvenience when an inadvertent tug or twist of the cord will disconnect the plug from the outlet. Continually powered outlets also pose the danger of electrical shock to a curious child who may insert a metallic object such as a key or a bobby pin into the outlet. A user is also posed to the risk of shock upon initial insertion of the plug when the user may unknowingly touch the plug's terminal prongs.

The vast majority of male plugs typically include a small ⅛" diameter hole within a standard distance from the end of the terminal prong. The prior art includes a variety of examples of how these holes may be engaged to prevent inadvertent release of the male plug, while some designs also add an alternative safety feature to reduce the outlets shocking potential.

In U.S. Pat. No. 5,286,213, the locking action is performed by ramps which urge the outlet's electrical contacts to clamp the broad sides of the plug's terminal prongs, the electrical contacts have small rounded nubs that engage the plugs prong holes. The outlet's contacts are isolated from their power source until the locking action has been performed by the user, which simultaneously energizes the outlet as the electrical contacts are turned into electrical communication with the power source. The principal drawback of this design poses the problem that the outlet is frictionally held in its locked position. An inadvertent twist of the cord can cause the plug to turn within the outlet and reverse the locking step, thus allowing for possible isolation from its power source, and reducing the clamping force applied upon the prongs making inadvertent disconnection more likely. Another drawback seen in this design is that the user must twist the plug relative to the outlet to exert the clamping force upon the prongs. The issue arises when the outlet's turning resistance increases as the ramps apply more clamping force on the electrical contacts to secure the plug's terminal prongs, causing undue stress to the plug's prongs as the user attempts to lock the plug tighter by turning it further. Over time, the extra stress may cause the plugs rigidly fixed prongs to become loose, causing electrical connection issues within the plug and creating a potential fire hazard. Another drawback of the design is that the clamping force must be continuously exerted upon the plug's terminal prongs by the outlet, causing the outlet to be under inherent constant stress anytime it is retaining a plug which may lead to premature wear or breakage to the outlet.

U.S. Pat. No. 5,791,931 has a grasping jaw having a hook portion to engage the plug's prong holes when urged by the moving carrier, which secures the plug's terminal prongs. A safety plug may be inserted and locked within the outlet to block insertion of a metallic object by a child. A key can also be required to unlock the safety plug from the outlet. The locked safety plug does offer an increased level of safety to a curious child by not allowing them to insert a metallic object into the continuously powered outlet, yet offers no increased safety to a user who may unknowingly touch the plug's terminal prongs during insertion. The safety plug or its key, may also easily be misplaced by the user when not in use, making this safety feature less user friendly than a typical outlet.

U.S. Pat. No. 5,795,168 uses a centrally located initiating member to urge locking members with protruding fixed pins to engage the prong holes when the plug is turned within the outlet. Electrical contacts mounted in slots in the outer periphery of the plug receptor grippingly engage fixed energized conductive contacts protruding into the plug receptors cavity to energize the outlet. The main problem seen in this design is that a curious child can still potentially be shocked by inserting a metallic object, such as a bobby pin, into the space between the plug receptors outer periphery and the inner periphery of its cavity to contact the continually powered protruding contacts.

U.S. Pat. No. 7,484,986 B1 uses insulated, manually operated buttons which have a shaft at their inner ends to engage the plug's prong holes. The user presses the buttons inward to engage their shafts through the plug's prong holes to thus secure the plug. This design is not easily adaptable to other arrangements, such as a wall outlet, because the sides of the outlet and the manually operated buttons would not be accessible to the user. This design is also continually energized which poses a risk of shock to an unwitting child who may insert a metallic object into the outlet, or to a user who may unknowingly touch the plug's terminal prongs during insertion.

OBJECTS AND ADVANTAGES

There is therefore a need to provide a protective electrical receptacle to create a safer environment for the user and the non-user alike in the home, workplace, or job site that will lessen the risk of possible minor or life threatening shock, while preventing inadvertent disconnection of the plug from the outlet. Accordingly, several objects and advantages of the present invention are:

(a) to provide a secure and constant electrical connection between a male plug and the outlet so as to decrease the possibility of unwanted accidental plug removal, as in the case of a worker using an electrically operated device high up on a roof, scaffolding, or ladder.

(b) to provide a means to mechanically hold the outlet in its locked position so that a simple inadvertent twist of the plug's cord will not release the outlet from its locked position, yet still be easily releasable when desired by the user.

(c) to be constructed in such a way as to secure a male plug in a method which imparts minimal stress upon the outlet and the plug during the locking and unlocking action steps so as to not lessen the durability of either.

(d) to be constructed in such a way as to retain a plug using a method which imparts minimal stress upon the outlet and plug during retention so as to not lessen the durability of either.

(e) to provide a protective electrical outlet employing safety features and locking action steps so as to remain in an un-energized state when idle, so as to lessen the possibility of electrical shock to a child who may unwittingly insert a metallic object into the outlet, or to a user who may unknowingly touch the plug's terminal prongs during insertion.

(f) to provide a locking action which simultaneously secures the plug and energizes the outlet so as to simplify use.

(g) to be constructed in such a way as to provide a means for the outlet to remain held in its unenergized position until it has been engaged by the plug's terminal prongs, so as to lessen the possibility of a shock to the user or a curious child.

(h) to provide a means to block the outlet's power source from contact by a curious child who may unwittingly insert a foreign object into the space between the movable receptacle assemblies outer periphery and the inner periphery of the cavity in which it resides, while still making said power source available to the receptacle assembly.

(i) to give full control to the user whether he or she desires the electrical receptacle to have live current available at a specific time, and to remain in that position when initiated properly by a male plug.

(j) to provide an outlet configuration that is easily adaptable to fit and form various arrangements such as a wall outlet or an extension cord outlet.

Further objects and advantages of our invention are to be designed and constructed in such a way as to utilize specific materials for the purpose of economical manufacture and ease of assembly. Another object of our invention is to easily replace conventional means of adjoining a male plug to an electrical power source regardless of voltage or amperage requirements, or plug's terminal configuration as the spirit of the invention is set forth. Further objects and advantages of our invention will become apparent from a consideration of the drawings and ensuing description.

SUMMARY OF THE INVENTION

In accordance with the present new invention described hereinafter as PROTECTIVE LOCKABLE FEMALE ELECTRICAL OUTLET, which provides a secure and constant electrical connection between a plug and the outlet, and can hold its locked position despite an inadvertent tug or twist of the cord. The method to secure and retain the plug offers minimal stress to the outlet and male plug so as to not substantially decrease the durability of either. The outlet lessens the shocking hazard to a user or unwitting child alike by remaining un-energized when idle, and prohibits movement from its idle position until the outlet has received the plug's terminal prongs. The shape of the receptacle assembly and the cavity in which it resides helps to inhibit an unwitting child from contacting the receptacle assemblies' power source with a metallic object such as a bobby pin. The outlets locking action steps give full control to the user whether he or she desires the electrical receptacle to have live current available, and can secure and energize the plug simultaneously during the locking action steps in a user friendly manner. The outlets design is easily adaptable to fit and form various arrangements such as a wall outlet, or an extension cord outlet, or of different voltage or amperage requirements.

DETAILED DESCRIPTION OF THE PREFERRED EMBODIMENT OF THE INVENTION

The outlet of this invention provides a safer and more secure means of connecting a plug to an outlet than found in typical models, and can be used with most types of standard electrical plugs having straight terminal blade prongs having a hole near their end. The outlet secures the plug into the outlet by engaging slidable lock pins through the plug's terminal prong holes when the receptacle is slightly pressed down and rotated in a clockwise direction relative to its housing by the user. The necessary action to lock the plug within the outlet also improves the safety of the receptacle. In the preferred arrangement the outlet is un-energized when idle, and is able to prohibit movement from its idle position until the outlets locking electrical contacts have received the plug's terminal prongs. The outlets locking action simultaneously brings the previously unenergized locking electrical contacts into electrical communication with their power supply, and the outlet is able to hold its locked position so as to prevent inadvertent disconnection of the plug from the outlet. The outlet allows for easy disconnection of the plug when desired by the user by reversing the locking action steps, and the modularized form of the receptacle module allows for easy adaptation to various outlet configurations such as a wall outlet or an extension cord outlet.

A better understanding of the details of the invention can be obtained by reference to the drawings that show a particular arrangement of the outlet. However, the further description of this invention in the context of a particular embodiment is not meant to limit the invention to the details disclosed therein.

Figure 1:
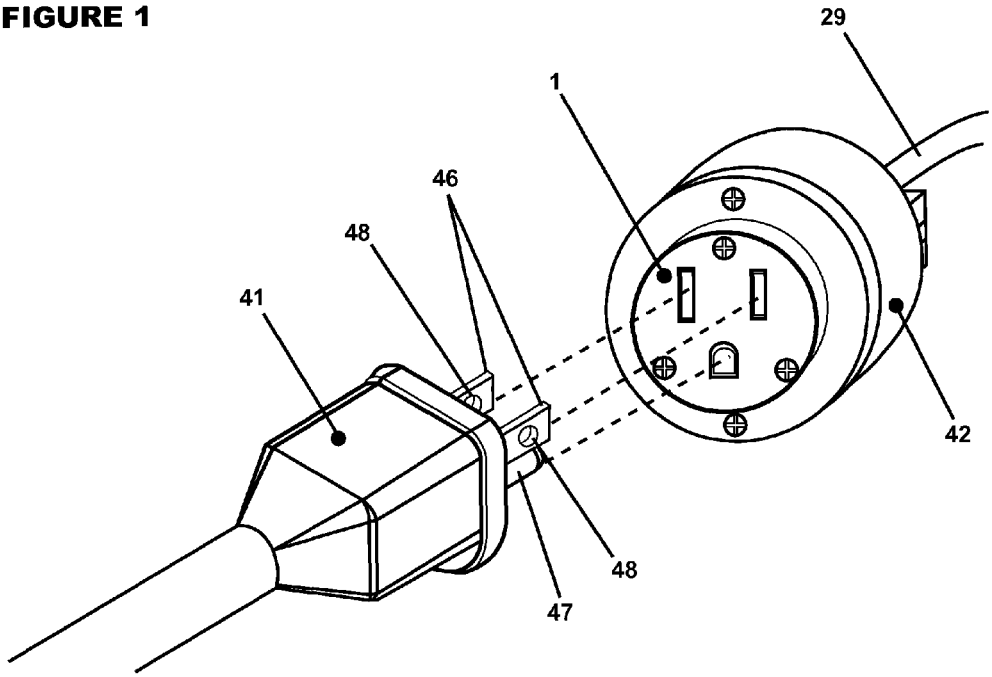
FIG. 1 is a perspective view of one form of the receptacle of the invention, an extension cord outlet, with a male plug positioned for insertion within.
Figure 6A:
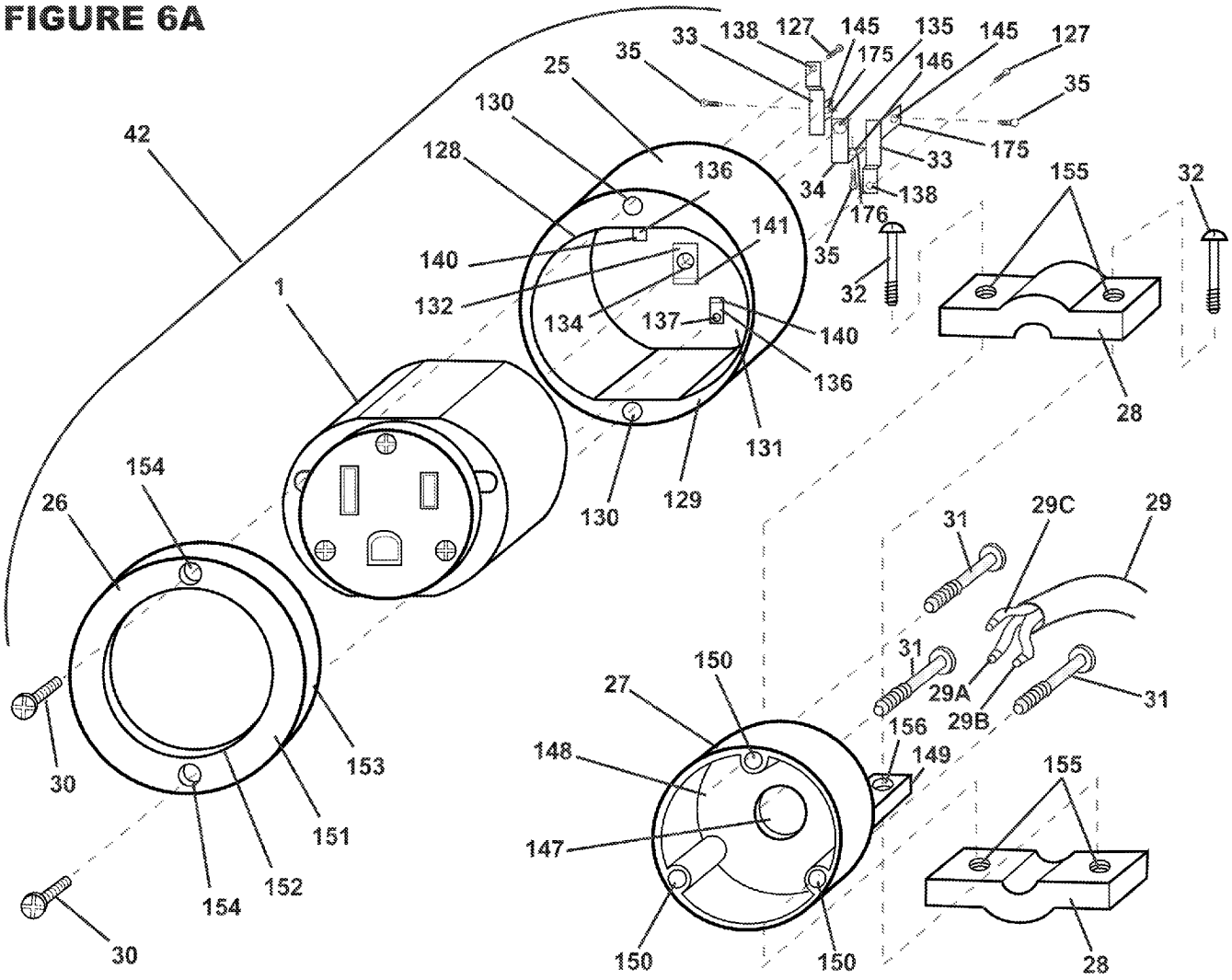
FIG. 6A is an exploded front view of one form of the outlet, an extension cord outlet.

FIG. 1 shows a receptacle module 1 in one arrangement, an extension cord outlet 42, which is attached to a power supply cord 29, and a male plug 41 positioned for insertion within. Said power supply cord 29 represents a typical extension cord, having; a line power wire 29A, a neutral wire 29B, and a ground wire 29C (FIG. 6A). Said male plug 41 has two terminal prongs 46 and a ground prong 47, the plug's terminal prongs 46 have a small hole 48 defined near their end. It should be noted that said receptacle module 1 of this invention is suitable for use in most types of outlet arrangements.

Figure 2:
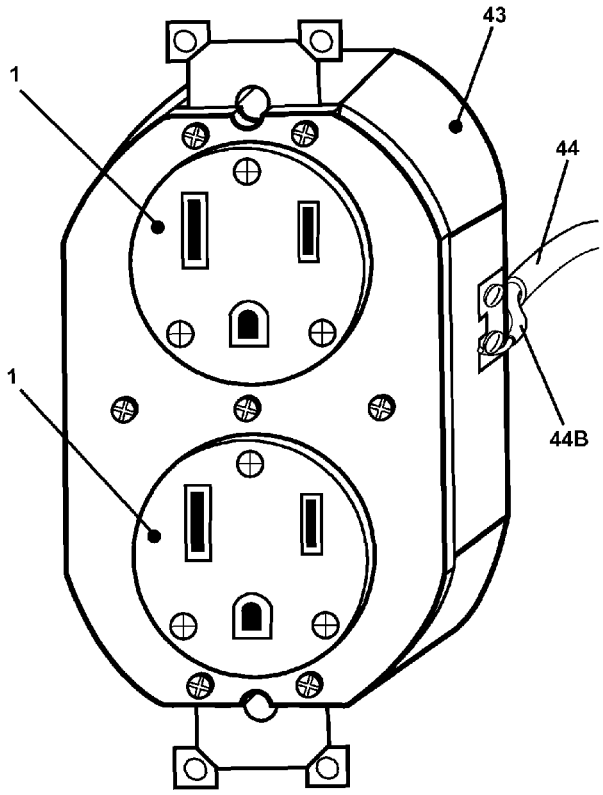
FIG. 2 is a perspective view of one form of the receptacle of the invention, a wall outlet.
Figure 5:
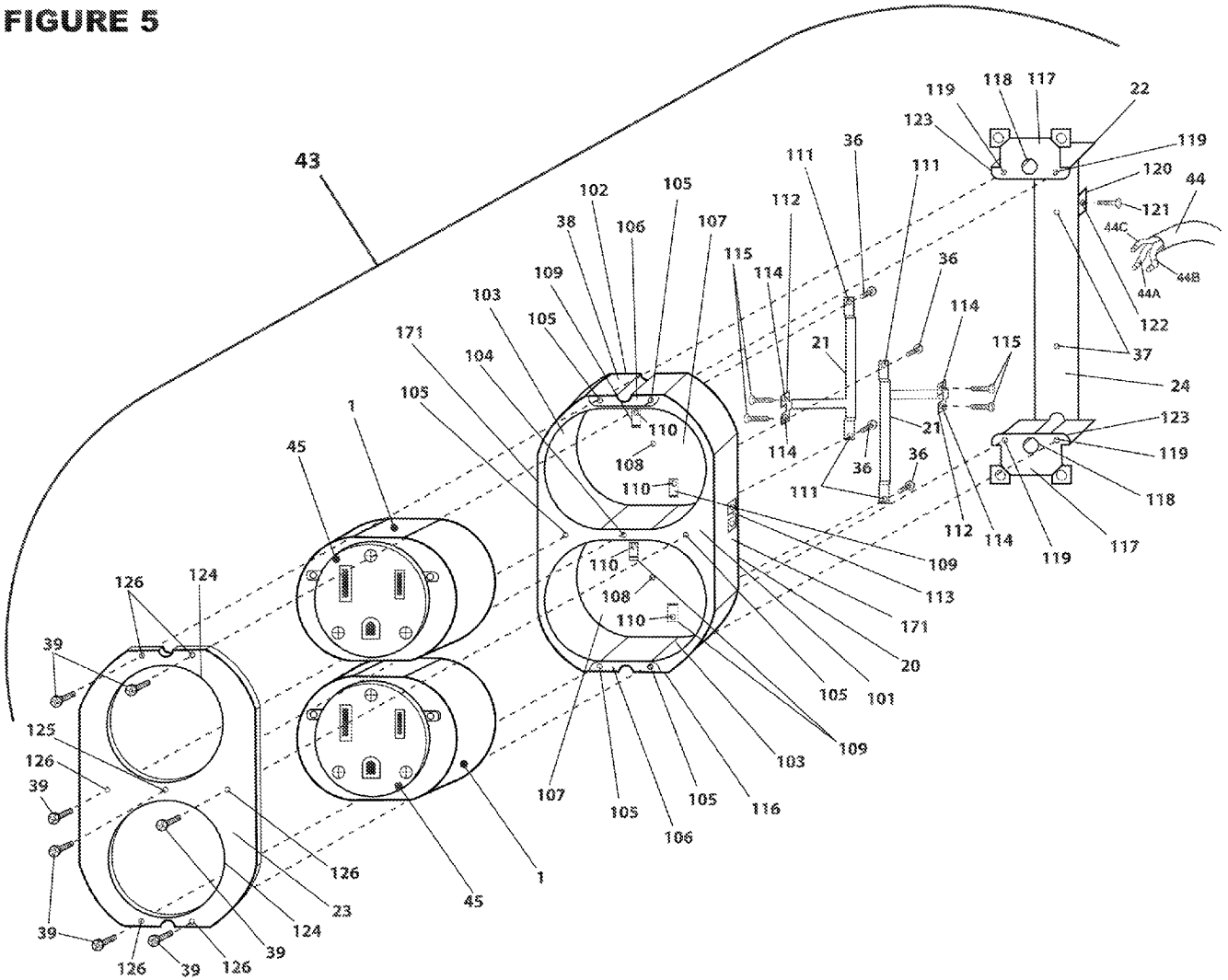
FIG. 5 is an exploded view of one form of the outlet, a wall outlet.

FIG. 2 shows said receptacle module 1 in another arrangement, a wall outlet 43, attached to its power supply wiring 44. Said power supply wiring 44 represents a typical extension buildings wiring, having; a line power wire 44A, a neutral wire 44B, and a ground wire 44C (FIG. 5). It should be noted that said receptacle module 1 of this invention is suitable for use in most types of outlet arrangements.

Figure 3A:
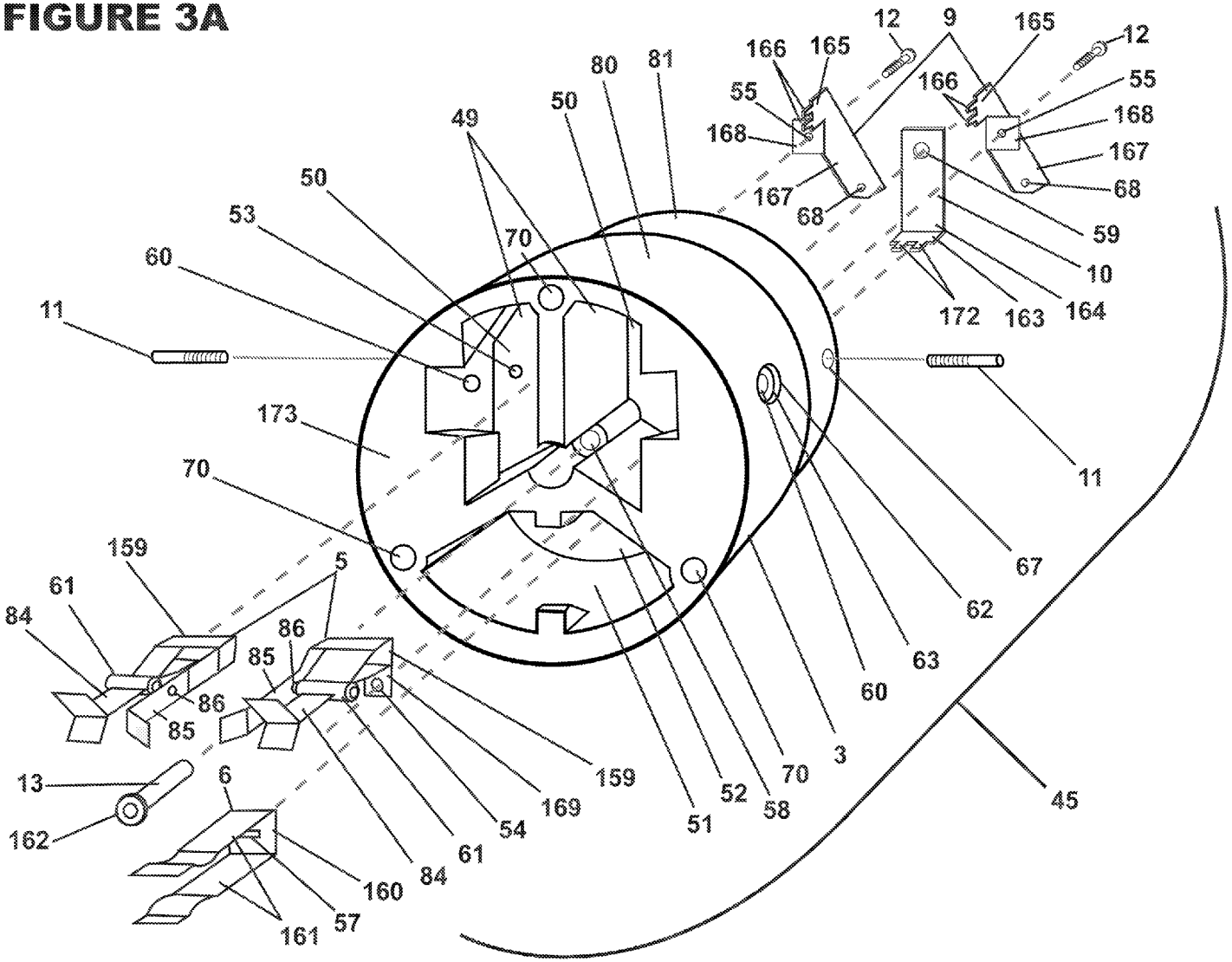
FIG. 3A is an exploded front view of the outlets receptacle assembly.
Figure 3B:
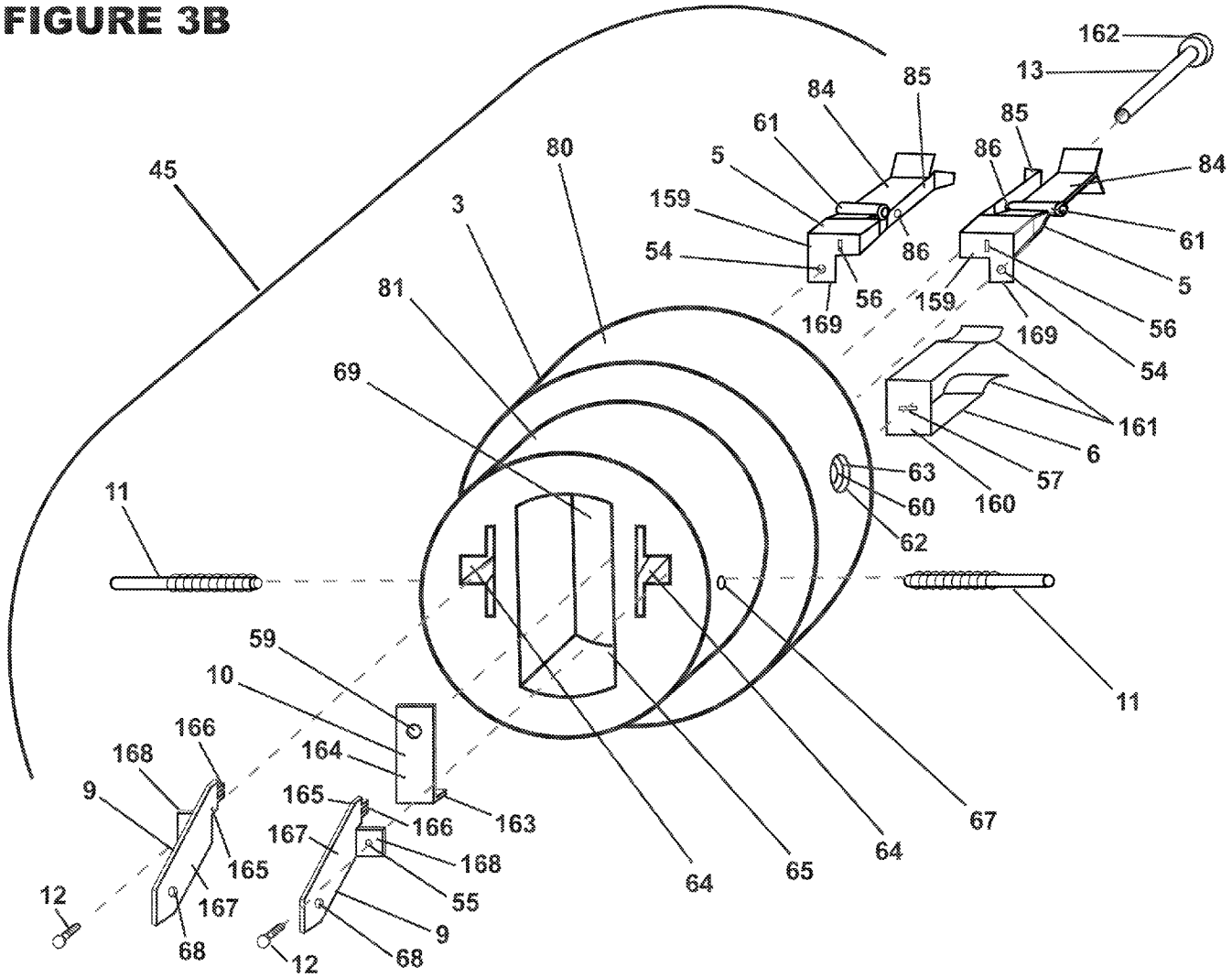
FIG. 3B is an exploded rear view of the outlets receptacle assembly.

FIGS. 3A and 3B show that a receptacle assembly 45 comprises; a line power locking electrical contact assembly 143, a neutral locking electrical contact assembly 144, and a ground contact assembly 133 being mounted within a receptacle body 3. Said contact assemblies 143, 144, 133 are shown unassembled (Reference FIGS. 8A, 8B, 8C, 8D for assembled version). Each of the locking electrical contact assemblies 143, 144 is comprised of a locking electrical contact 5, an electrical terminal 9, and a guide pin 11 being in electrical communication with each other. Said ground contact assembly 133 is comprised of a ground prong contact 6, a ground terminal 10, and a retaining screw sleeve 13 being in electrical communication with each other.

Said receptacle body 3 is formed from a suitable rigid non-conductive material, and has a cylindrical forward section 80 having an outer periphery, and has a cylindrical rear section 81 having an outer periphery of smaller circumference than said forward section 80 outer periphery. The body forward section 80 has a flat front surface 173 having screw holes 70 defined near its outer periphery, said front surface 173 also having cavities defined within, including; a pair of contact cavities 49 formed on opposite sides of said bodies 3 central axis, a ground contact cavity 51 formed on said bodies 3 lower central axis, and a centrally located retaining screw cavity 58.

As seen in FIG. 3B the receptacle body rear section 81 has a pair of terminal cavities 64 formed separately and on opposite sides of a centrally located ground terminal cavity 65.

Said contact cavities 49 (FIG. 3A) accept said plug's terminal prongs 46, and individually house said locking electrical contacts 5. Said contact cavities 49 are defined by a flat floor surface 50 at their base which said electrical terminals 9 protrude through, a rivet hole 53 defined in said floor 50 extends into said terminal cavity 64. A lock pin hole 60 is defined into the side of said contact cavities 49 in a proximate location to correspond with the plug's prong holes 48, and extends outward to said bodies 3 outer periphery where said lock pin hole 60 defines a recessed area 62 having a flat floor surface 63 at its base.

Said ground contact cavity 51 houses said ground prong contact 6 and is defined by a flat floor surface 52 at its base which said ground terminal 10 protrudes through. Said retaining screw cavity 58 is cylindrically shaped and extends through said receptacle body 3. Said retaining screw cavity 58 receives said retaining screw sleeve 13.

Said terminal cavities 64 individually house said electrical terminals 9, and have a flat floor surface 66 (FIGS. 8A, 8B, 8C, 8D) defined at their base which said electrical terminals 9 extend through and, the corresponding contact cavity 49. A guide pin hole 67 is formed into the side of said terminal cavities 64 and extends outward through the body rear section 81 outer periphery.

Said ground terminal cavity 65 is defined by a flat floor surface 69 at its base having said retaining screw cavity 58 defined through its center, said ground terminal 10 also mounts within said floor 69.

Said electrical terminals 9 mount within said terminal cavities 64, and are formed from a suitably rigid highly conductive material. Said electrical terminals 9 have a short section 165 having protruding legs 166, said short section 165 mounts through said terminal cavity floor 66 and extends into said contact cavity 49 to accept said locking electrical contact 5. Said terminals 9 also have a long section 167 which extends back at a downward angle, and has a guide pin 68 hole defined in a location to correspond with the terminal cavity guide pin holes 67. A mounting tab 168 protrudes outward from said terminal 9, and has a rivet hole 55 defined in a location which corresponds with the terminal cavity floor rivet hole 53.

Said guide pins 11 are formed from a suitably rigid highly conductive material and are formed as a tubular shape. Said guide pins 11 pass through said terminal cavity guide pin holes 67 to fixably mount in the terminal guide pin holes 68. Said guide pins 11 protrude separately outward from the receptacle body rear sections 81 central horizontal axis.

Said locking electrical contacts 5 mount within said contact cavities 49 (FIG. 3A), and are formed from any suitably rigid highly conductive material. The locking contacts 5 have an inner prong contact terminal 85, and have an outer prong contact terminal 84 protruding from a base 159. The prong contact terminals 84, 85 are biased together to receive said plug's terminal prongs 46. The outer contact terminal 84 has a channel 61 formed at a location to correspond with said plug's prong holes 48, said channel 61 extends outward to mount within the contact cavity lock pin hole 60. The inner contact terminal 85 has a hole 86 defined at a location to correspond with the plug's prong holes 48. A slot 56 formed through the locking contact base 159 accepts the terminal legs 166, which are swaged within to retain said locking contacts 5 and form electrical communication between said terminal 9 and said contact 5. A rivet hole 54 is formed through a mounting tab 169 protruding from the contact base 159 and corresponds with the floor surface rivet hole 53, and also corresponds with the terminal rivet hole 55, which are secured together with a rivet 12.

Said retaining screw sleeve 13 is formed from a suitably rigid highly conductive material, and is formed as a hollow cylindrical shape having a circular flange 162 at one end. Said sleeve 13 mounts within said retaining screw cavity 58 and extends into said ground terminal cavity 65. Said flange 162 limits how deeply said sleeve 13 can be mounted within said retaining screw cavity 58.

Said ground terminal 10 is formed from a suitably rigid highly conductive material, and is formed as an "L" shape. Said ground terminal 10 has a short section 163 having protruding legs 172, and has a long section 164 having a sleeve hole 59 defined near its end. Said ground terminal 10 mounts within said ground terminal cavity 65, the ground terminal short section 163 extends through said ground terminal cavity floor 69 and protrudes into said ground contact cavity 51. The ground terminal long section 164 lays flat on said floor surface 69 so that said sleeve hole 59 is positioned to meet said retaining screw cavity 58. Said sleeve hole 59 accepts said retaining screw sleeve 13, which is swaged within to secure said sleeve 13 and said ground terminal 10 within said body 3, and also forms electrical ground communication between said sleeve 13 and said ground terminal 10.

Said ground prong contact 6 is formed from a suitably rigid highly conductive material, and mounts within said ground contact cavity 51. Said ground prong contact 6 has a base 160 having a slot 57 defined which accepts the ground terminal legs 172. Said legs 172 are swaged within said slot 57 to retain and form electrical communication between said ground prong contact 6 and said ground terminal 10. A pair of ground prong contact terminals 161 extends outward from said ground contact base 160 which receive the plug's ground prong 47.

Figure 4A:
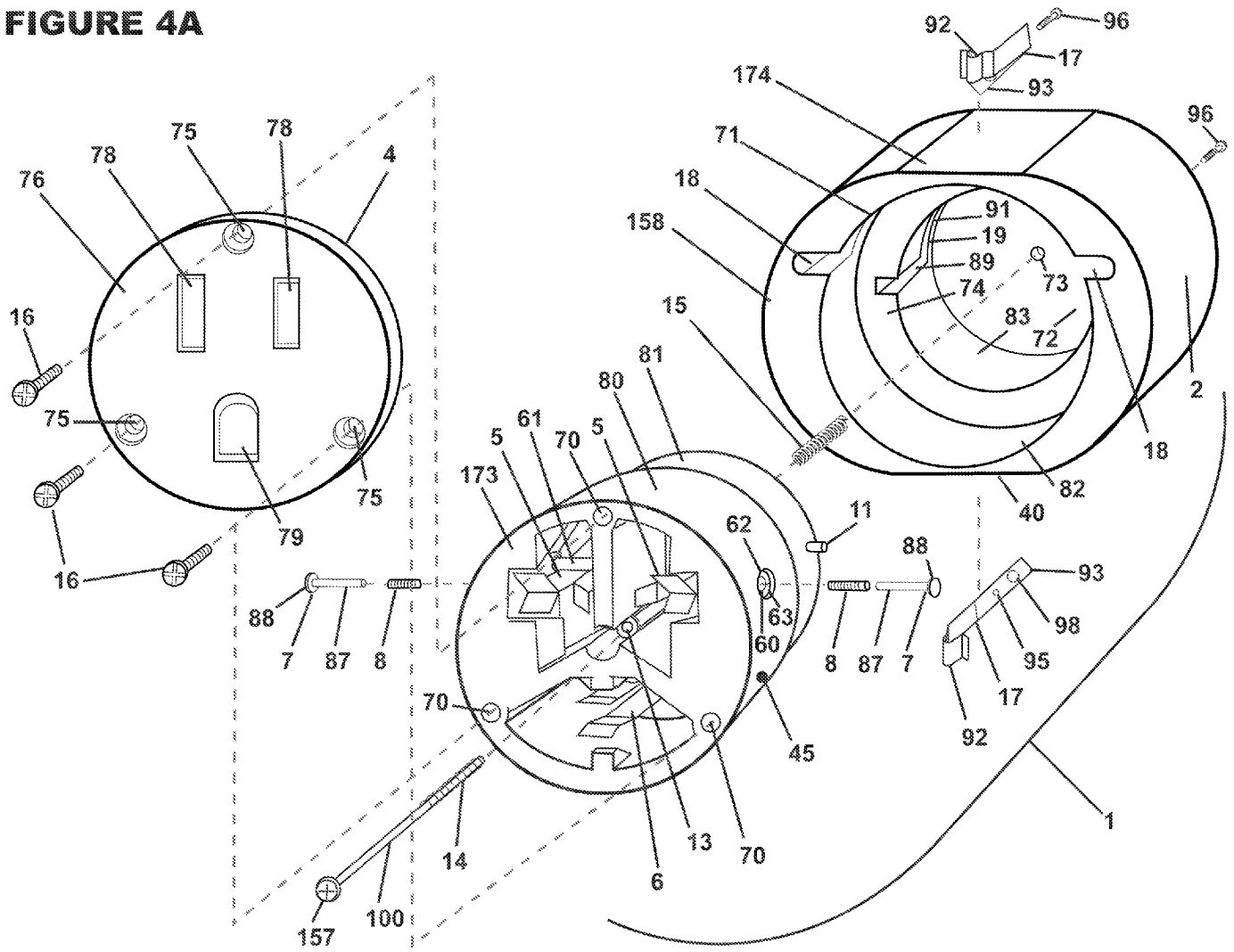
FIG. 4A is an exploded front view of the outlets receptacle module.
Figure 4B:
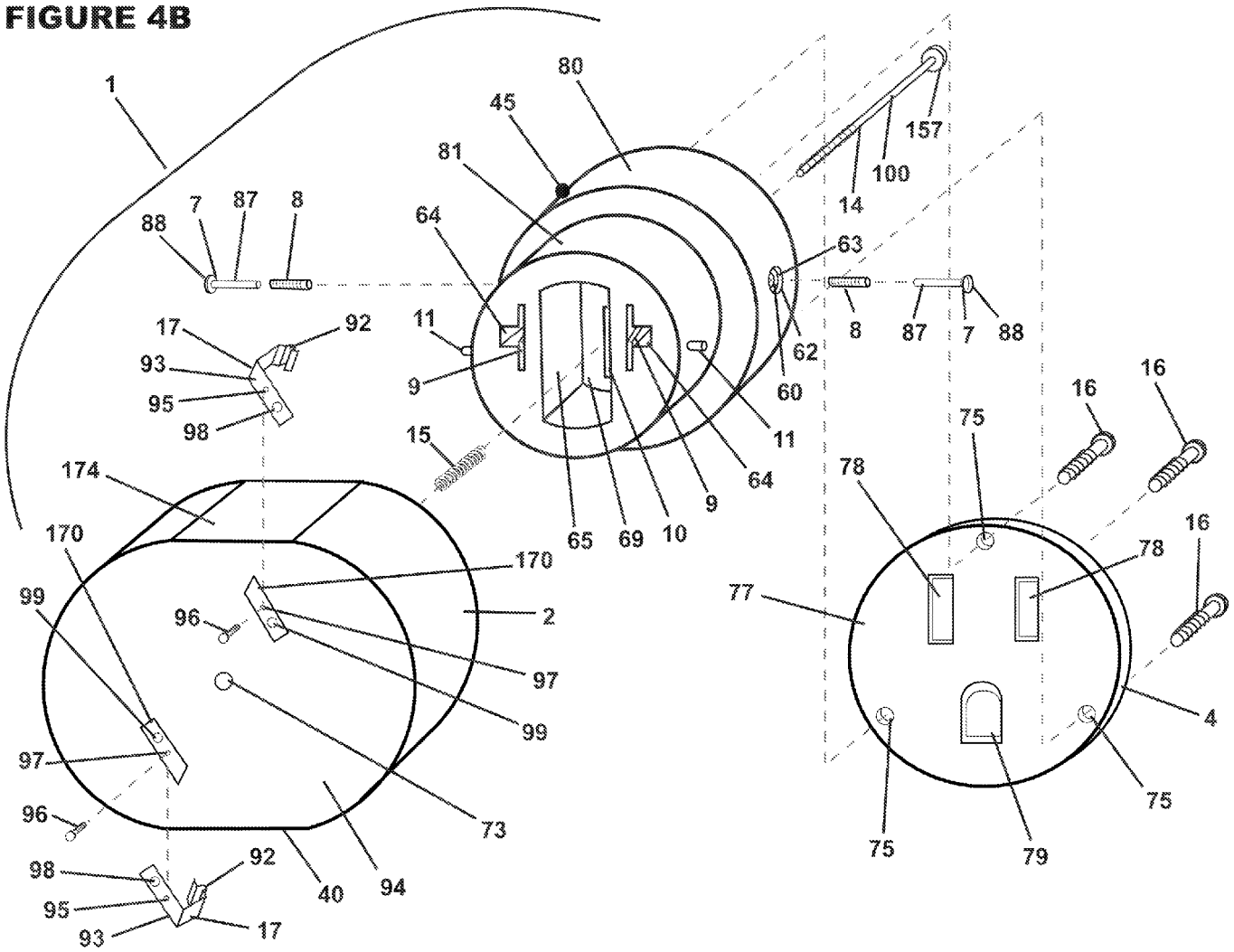
FIG. 4B is an exploded rear view of the outlets receptacle module.

As shown in FIGS. 4A and 4B, the receptacle module 1 comprises a receptacle housing 2, said receptacle assembly 45, a receptacle cap 4 and its screws 16, a retaining screw 14, a return spring 15, a pair of lock pins 7, and a pair of lock pin springs 8.

Said receptacle housing 2 is formed from a suitably rigid non conductive material and takes the form of an oval shaped cylinder having a flat top surface 174, and a flat bottom surface 40. Said receptacle housing 2 is defined by a front surface 158 having a central cavity 71 defined, which accepts said receptacle assembly 45. Said receptacle housing 2 has a flat rear surface 94 (FIG. 4B) having a pair of recessed areas 170 defined separately and on opposite sides near its outer periphery. Said recessed areas 170 having rivet holes 97, 99 defined within. Said rear surface 94 also has a centrally located screw hole 73 which extends into the receptacle housing cavity 71.

The receptacle housing cavity 71 (FIG. 4A) has a substantially cylindrical forward chamber 82 having an inner periphery of approximate commensurate size of said body forward section 80 outer periphery. Said forward chamber 82 has a pair of horizontal engagement ramps 18 defined on opposite sides of its inner periphery. Said engagement ramps 18 start just above said forward chamber 82 central axis, and decrease in depth in a clockwise direction. Both ends of said engagement ramps 18 travel upward to meet the receptacle housing front surface 158 (best seen in FIGS. 7A, 7B, 7C, 7D). Said forward chamber 82 is defined by a flat circular shaped floor 74 at its base, having a centrally located rear chamber 83 defined within.

The substantially cylindrical rear chamber 83 has an inner periphery having a smaller circumference than said forward chamber 82 inner periphery. Said rear chamber 83 inner periphery being of approximate commensurate size of said receptacle body rear sections 81 outer periphery. A pair of channel-ways 19 defined on opposite sides of said rear chamber 83 inner periphery accept said guide pins 11. Said channel-ways 19 are defined by a pair of separate vertical detent slots 89, 90 of different lengths being joined at their base by an interposed horizontal slot 91 (FIGS. 7A, 7B, 7C, 7D). The channelway long vertical detent slot 89 is located on the horizontal central axis of said rear chamber 83, and extends upward through said upper chamber floor surface 74. The channel-way short vertical detent slot 90 extends upward to meet a guide pin contact 17 which protrudes into said channel-way short vertical slot 90 (FIGS. 7A, 7B, 7C, 7D).

Said rear chamber 83 is defined by flat floor surface 72 at its base having said screw hole 73 defined at its center.

Said lock pins 7 are formed from a suitably rigid material, and define a tubular shaft 87 having a dome shaped head 88. The lock pin shaft 87 is slidably carried by the locking contact outer terminal channel 61, the lock pin head 88 fits within the lock pin hole recessed area 62 when depressed. Said lock pin spring 8 mounts around said lock pin shaft 87 and is positioned between said lock pin head 88 and the lock pin hole recessed area floor 63.

Said retaining screw 14 is formed from a suitably rigid highly conductive material, and defines a shaft 100 and a head 157. The retaining screw shaft 100 slidably passes through said retaining screw sleeve 13, the end of said shaft 100 mounts within the rear chamber floor screw hole 73 and protrudes outward from the receptacle housing base 94 for use in mounting said receptacle module 1 as hereinafter described. The retaining screw head 157 retains said receptacle assembly 45 within said cavity 71.

Said return spring 15 mounts around the retaining screw shaft 100 and is disposed between said receptacle assembly 45 and the rear chamber floor surface 72.

Said guide pin contact 17 is formed from a suitably rigid highly conductive material, and has a semi circular head 92, and has a base 93. The guide pin contact head 92 protrudes into the top of said channel-way short vertical detent slot 90. The guide pin contact base 93 extends outward through said receptacle housing rear surface 94 and bends to lay flat within said recessed area 170. Said guide pin contacts 17 are secured to said receptacle housing 2 with a rivet 96 passing through a rivet hole 95 defined in the guide pin contact base 93 and passing through the corresponding recessed area rivet hole 97. An additional rivet hole 98 is formed into said guide pin contact base 93 which corresponds with said rivet hole 99 formed into the recessed area 170, for use in mounting the receptacle module 1 as hereinafter described.

Said locking electrical contacts 5, said ground prong contact 6, said retaining screw 14, and said retaining screw sleeve 13 are enclosed within their respective cavities by the circular shaped receptacle cap 4. Said receptacle cap 4 outer periphery is of commensurate size of said body forward section 80 outer periphery, and is formed from a suitably rigid non conductive material. Said receptacle cap 4 has a flat front surface 76 and a flat rear surface 77 having a pair of separate elongated slots 78 defined which are located on opposite sides of the central axis to receive said plug's terminal prongs 46. Said cap 4 also has a hole 79 located on the lower central axis to accept said plug's ground prong 47. Screw holes 75 located near said cap 4 outer periphery accept the receptacle cap screws 16, said cap screws 16 mount within the receptacle body screw holes 70, thus affixing said cap 4 to the receptacle bodies front surface 173.

As shown in FIG. 5 the receptacle module 1 may be arranged as a wall outlet 43, comprising; a wall outlet housing 20, a pair of wall outlet electrical terminals 21 and their rivets 36 and screws 115, a mounting bracket 22 and its ground screw 121, a front cover 23 and its screws 39, and two receptacle modules 1.

Said wall outlet housing 20 is formed from a suitably rigid non conductive material, and is constructed in a rectangular boxlike shape having rounded corners. Said wall outlet housing 20 comprises; a flat front surface 101, a flat rear surface 102, a flat top surface 38, a flat bottom surface 116, and a pair of flat side surfaces 171. The wall outlet housing front surface 101 has two cavities 103 formed into its central axis which accept the receptacle modules 1. Said front surface 101 also has a screw hole 104 centrally located between said cavities 103, and has screw holes 105 defined near its outer periphery. A recessed area 106 is located at the top and bottom of said wall outlet housing front surface 101 outer periphery. Said recessed areas 106 have screw holes 105 defined within.

The wall outlet housing cavities 103 are of approximate commensurate size and shape of said receptacle module 1 outer periphery, and have a flat floor surface 107 defined at their base. Said floor surface 107 has a pair of recessed areas 109 formed separately into each side of said floor surface 107 central axis, which have a rivet hole 110 defined within which extend outward through said wall outlet housing rear surface 102. Said floor surfaces 107 also have a centrally located screw hole 108 defined which extend outward through the wall outlet housing rear surface 102. Said receptacle modules 1 protruding retaining screw 14 mounts within, and extends fully through the wall outlet housing cavities screw holes 108, thus retaining the receptacle module 1 within said wall outlet housings cavities 103.

Said wall outlet terminals 21 are constructed from a suitably rigid highly conductive material, and are formed into a shape resembling an elongated "T," having screw holes 111 defined near their ends. Said wall outlet terminals 21 mount within said cavity recessed areas 109 and thus protrude into said cavities 103. Said screws 36 pass through the wall outlet terminal screw holes 111 and mount within the guide pin contact hole 98 to thus form electrical communication between said wall outlet terminals 21 and said guide pin contacts 17 (FIGS. 4A, 4B), which also secures said receptacle module 1 within said wall outlet housing cavity 103. A section of said wall outlet terminals 21 extend sideways within said wall outlet housing rear surface 102 horizontal central axis, and protrude outward through the wall outlet housing side surface 171, where said wall outlet terminals 21 are bent to form flanges 112. The wall outlet housing sides 171 have a terminal flange recessed area 113 defined within which accept the terminal flanges 112. Screws 115 pass through the terminal flanges screw holes 114 to accept and secure the corresponding power supply wiring 44A, 44B.

Said mounting bracket 22 is formed from a suitable rigid highly conductive material, and has a flat elongated rear surface 24 which mounts longitudinally to said wall outlet housing rear surface 102. The mounting bracket rear surface 24 has two screw holes 37 defined which accept the receptacle modules 1 protruding retaining screws 14 to form an electrical ground communication between said mounting bracket 22 and said retaining screws 14. Said mounting bracket 22 bends at a right angle and extends upward from its rear surface 24 to fit alongside the wall outlet housing top surface 38, and alongside said bottom surface 116, and then bends outward at a right angle to form a mounting flange 117 at a predetermined frontal location. Screw holes 118 formed through said mounting flange 117 serve as a point of attachment to a typical wall outlet electrical box (not shown). The inner flange areas 123 extend slightly inward to fit within the wall outlet housing front surface recessed areas 106. Screw holes 119 are formed through said inner flanges 123, and correspond with the recessed area screw holes 105. A grounding flange 120 extends outward from said mounting bracket rear surface 24 and bends at a right angle to protrude downward. Said grounding flange 120 defines a screw hole 122 which accepts a screw 121 to secure the corresponding power supply ground wire 44C (not shown).

The flat front cover 23 is formed from a suitably rigid non conductive material, and is formed in a commensurate size and shape of said wall outlet housing front surface 101 outer periphery. Said front cover 23 has two circular receptacle holes 124 defined in a location to correspond with said receptacle assemblies 45, to allow said receptacle assemblies 45 to protrude through. A centrally located screw hole 125 is formed between the covers receptacle holes 124, additional screw holes 126 are defined near said cover 23 outer periphery. Screws 39 pass through the front cover screw holes 126 and mount within the corresponding wall outlet housing front surface screw holes 105, to thus affix said front cover 23 to said wall outlet housing front surface 101 thereby enclosing said receptacle modules 1 within said cavities 103.

Figure 6B:
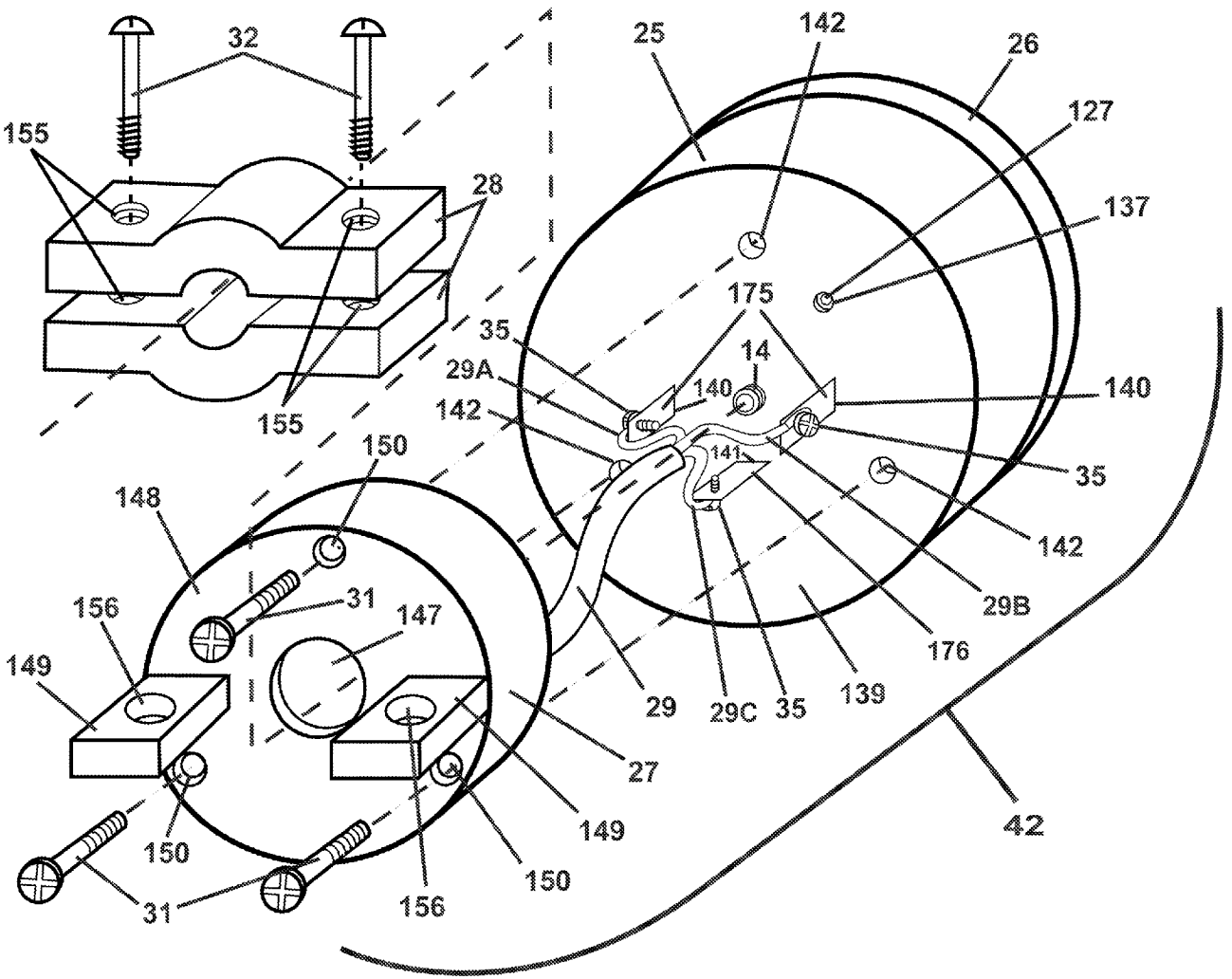
FIG. 6B is a partially exploded rear perspective view of one form of the outlet, an extension cord outlet.

As shown in FIGS. 6A and 6B the receptacle module 1 may be arranged as an extension cord outlet 42, comprising; an extension cord outlet housing 25, a pair of extension cord outlet terminals 33 and their rivets 127 and screws 35, an extension cord outlet ground terminal 34 and its screw 35, a receptacle module 1, a front cap 26 and its screws 30, a terminal cap 27 and its screws 31, said power supply cord 29, and a pair of cord clamps 28 and their screws 32.

The cylindrically shaped extension cord outlet housing 25 is formed from a suitably rigid non conductive material, and has a flat front surface 129 having a centrally located cavity 128 defined, and has screw holes 130 defined above and below said cavity 128. Said cavity 128 is of approximate commensurate size and shape of said receptacle modules 1 outer periphery and has a flat floor surface 131 defined at its base. Said floor surface 131 having a central recessed area 132 having a screw hole 134 defined within, which extends outward through the extension cord outlet rear surface 139. Said cavity floor 131 has an additional pair of offset recessed areas 136 formed separately into each side of its central axis, which have a rivet hole 137 defined within which extends outward through the extension cord outlet housings rear surface 139.

Said extension cord outlet housing rear surface 139 is flat and has two slots 140 defined separately into each side of its central axis, and extend inward to meet the cavity floor offset recessed areas 136. An additional slot 141 extends through said rear surfaces 139 lower central axis to meet the central recessed area 132. Screw holes 142 are formed near the outer periphery of said rear surface 139.

Said extension cord outlet terminals 33 are constructed from a suitably rigid conductive material, and are formed into an "L" shape, and mount within the cavity floor offset recessed areas 136. Said extension cord outlet terminals 33 extend outward through the rear surface slots 140 where they define a terminal flange 175. A rivet hole 138 formed near the end of said extension cord outlet terminals 33 corresponds with the guide pin contact rivet hole 98 (FIGS. 4A, 4B). Said rivet holes 98, 138 are connected together by said rivet 127 to thus form electrical communication between said guide pin contacts 17 and said extension cord outlet terminal 33 which also secures said receptacle module 1 within said cavity 128. A screw hole 145 defined in said terminal flange 175 accepts said screw 35 which accepts and secures the corresponding power supply cord wires 29A, 29B to energize said extension cord outlets electrical terminals 33 and thus energize said guide pin contacts 17.

Said extension cord outlet ground terminal 34 is constructed from a suitably rigid conductive material, and is formed into an "L" shape to mount within the cavities centrally located recessed area 132. Said extension cord outlet ground terminal 34 extends outward through the rear surface slot 141 where it forms a ground terminal flange 176. A screw hole 135 defined in said extension cord outlet ground terminal 34 corresponds with the cavity central recessed area screw hole 134. Said screw holes 134, 135 accept said receptacle module's 1 protruding retaining screw 14 to form an electrical ground communication between said retaining screw 14 and said extension cord outlet ground terminal 34, which also secures said receptacle module 1 within said cavity 128. A screw hole 146 defined in said extension cord outlet ground terminal flange 176 accepts said screw 35, which secures the corresponding power supply cord ground wire 29C, to thus form an electrical grounding connection between, said ground wire 29C, said extension cord outlet ground terminal 34, and said retaining screw 14.

The hollow cylindrically shaped terminal cap 27 is formed from a suitably strong, rigid, non conductive material, and has a flat rear surface 148 having a hole 147 defined through its center which said power supply cord 29 passes through. Said rear surface 148 also has two elongated blocks 149 formed on plane near its outer periphery, said blocks 149 extend outward and have a screw hole 156 defined. The terminal cap screws 31 pass through screw holes 150 formed near the outer periphery of said terminal cap 27. Said screws 31 mount within the extension cord outlet housing rear surface screw holes 142 to thus affix said terminal cap 27 to said extension cord outlet housing rear surface 139. Said terminal cap 27 thus encloses; said extension cord outlet terminal flanges 175, said extension cord outlet ground terminal flange 176, and said power supply cord 29.

The circular shaped front cap 26 is formed from a suitably rigid non conductive material, and has a flat front surface 151 having a receptacle hole 152 defined at its center. Said front surface 151 has screw holes 154 defined above and below said receptacle hole 152, a flange 153 is formed at said caps 26 outer periphery and extends back. Said front cap 26 mounts to the extension cord outlet housing front surface 129 to enclose said receptacle module 1 within said cavity 128, said receptacle assembly 45 passes through said receptacle hole 152. The front cap screws 30 pass through said screw holes 154 and mount within the extension cord outlet housing front surface screw holes 130 to thus affix said cap 26 to said extension cord outlet housing front surface 129.

Said cord clamps 28 are formed from a suitably rigid non conductive material, and are formed as elongated blocks having screw holes 155 defined near their ends. Said cord clamps 28 are affixed to the terminal cap elongated blocks 149 by a pair of screws 32 passing through the cord clamp screw holes 155 and through the terminal cap elongated block screw holes 156. The power supply cord 29 is clamped between said cord clamps 28 to thus secure said cord 29 to said terminal cap 27.

Operation

FIGS. 7A, 7B, 7C, 7D, 8A, 8B, 8C, 8D

FIGS. 7A, 7B, 7C, 7D, are cutaway views of the receptacle module 1 showing said receptacle assembly 45 in the various steps of the locking sequence. It should be understood that said engagement ramps 18 are defined into the receptacle housing cavity forward chamber 82 inner periphery, and that said channel-ways 19 are formed into said receptacle housing cavity rear chamber 83 inner periphery.

FIGS. 8A, 8B, 8C, 8D are cutaway views of said extension cord outlet 42 with said plug 41 inserted, and showing the locking action steps of said receptacle module 1 which are performed by said user. Said guide pin contacts 17 are connected to the power source through their connection to said extension cord outlet housing electrical terminals 33 (FIGS. 6A and 6B).

Figure 7B:
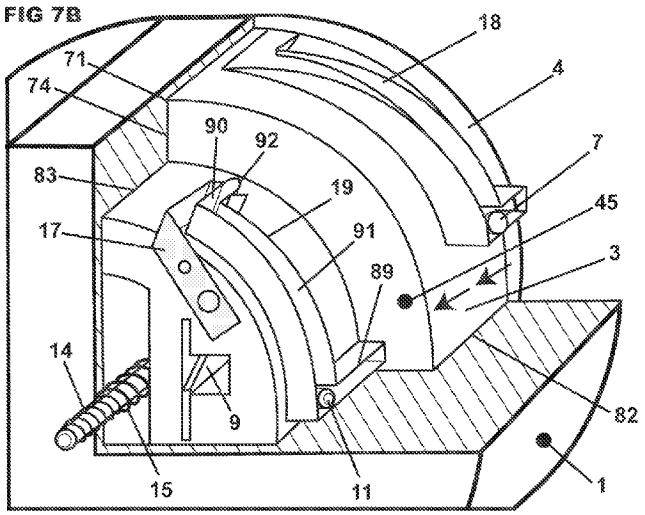
FIGS. 7A, 7B, 7C, and 7D are partial rear cutaway views of the outlets receptacle module showing the various steps of the locking action sequence.
Figure 7D:
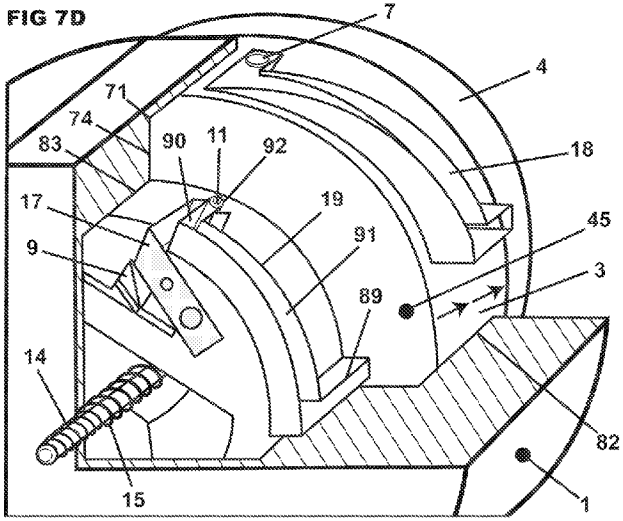
Figure 7A:
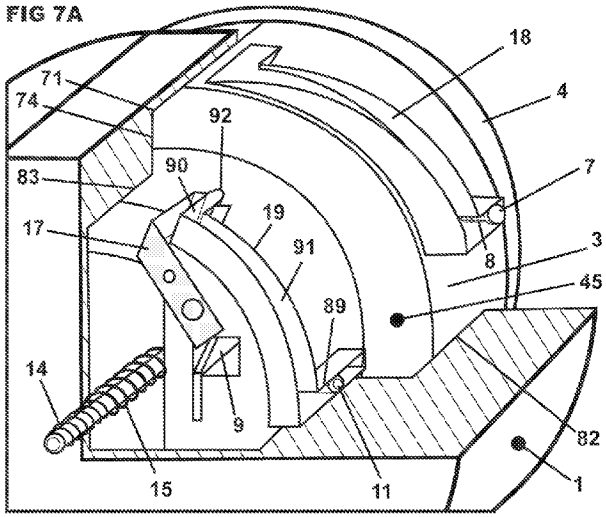
Figure 8A:
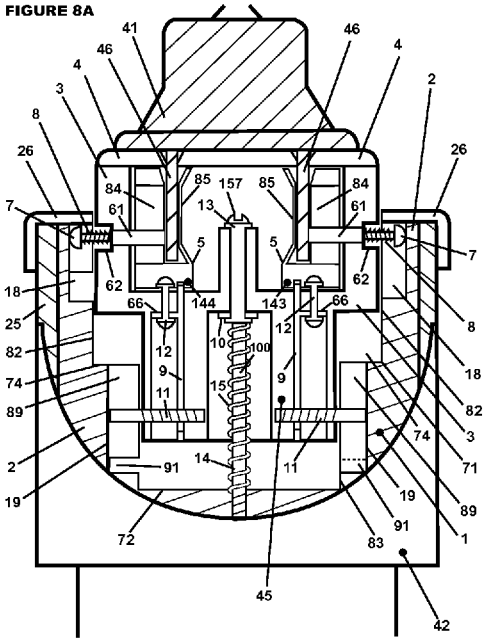
FIGS. 8A, 8B, 8C, and 8D are partial cutaway views of the extension cord outlet with a plug inserted, showing various steps of the outlets locking action sequence.

As seen in FIGS. 7A and 8A, said receptacle modules 1 first locking action step in which said receptacle assembly 45 is in its outward unlocked position and said locking electrical contacts 5 are not energized. Said plug 41 has been inserted by said user and said locking electrical contacts 5 have received said plug's terminal prongs 46.

Said receptacle assembly 45 is carried within said receptacle housing cavity 71, and is slidable and rotatable upon said retaining screw shaft 100. Said return spring 15 pushes outward on said receptacle assembly 45 and urges said receptacle assembly 45 to hold its outward position, said retaining screw head 157 limits the outward travel of said receptacle assembly 45.

A continuous electrical grounding circuit is formed between; said retaining screw 14, said retaining screw sleeve 13, said ground terminal 10, and said ground prong contact 6 (FIGS. 3A, 3B). Said ground prong contact 6 accepts said plug's ground prong 47 (FIG. 1).

Said lock pins 7 are positioned within the deepest recessed area of said engagement ramps 18, and are urged to their most outward position by said lock pin springs 8. Said lock pins 7 are thus not engaged through said plug's prong holes 48 (FIG. 1).

In this locking action step said guide pins 11 are electrically isolated in said channel-way long vertical detent slot 89 which prohibits said receptacle assembly 45 from turning. Said receptacle assembly 45 is slidable and may travel downward when moved by said user, as seen in the second locking action step (FIGS. 7B, 8B).

Figure 8B:
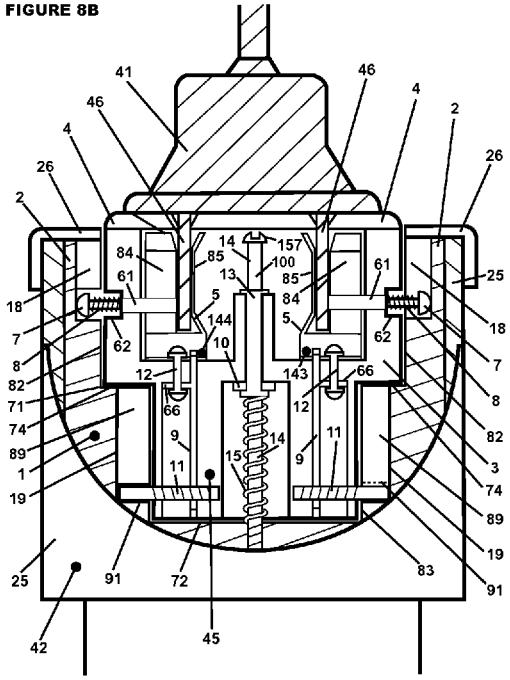

FIGS. 7B and 8B show the receptacle modules 1 second locking action step in which said receptacle assembly 45 has been depressed by said user, with said male plug 41 inserted but not yet locked within, said locking electrical contacts 5 are not energized.

Said retaining screw 14 allows said receptacle assembly 45 to slide and pivot within said receptacle housing cavity 71 while said return spring 15 exerts a continuous outward force upon said receptacle assembly 45.

A continuous electrical grounding circuit is formed between; said retaining screw 14, said retaining screw sleeve 13, said ground terminal 10, and said ground prong contact 6 (FIGS. 3A, 3B). Said ground prong contact 6 accepts said plug's ground prong 47 (FIG. 1).

Said lock pins 7 are positioned within the deepest recessed area of said engagement ramps 18, and are urged to their most outward position by said lock pin springs 8. Said lock pins 7 are thus not engaged through said plug's prong holes 48 (FIG. 1).

In this step said guide pins 11 are electrically isolated, and are positioned where said channel-way long vertical detent slot 89 and said channel-way horizontal slot 91 meet. In this position said horizontal slots 91 will allow said guide pins 11 to pass through them in a clockwise direction, thus allowing said receptacle assembly 45 to rotate to the position seen in the third locking action step (FIGS. 7C and 8C).

Figure 7C:
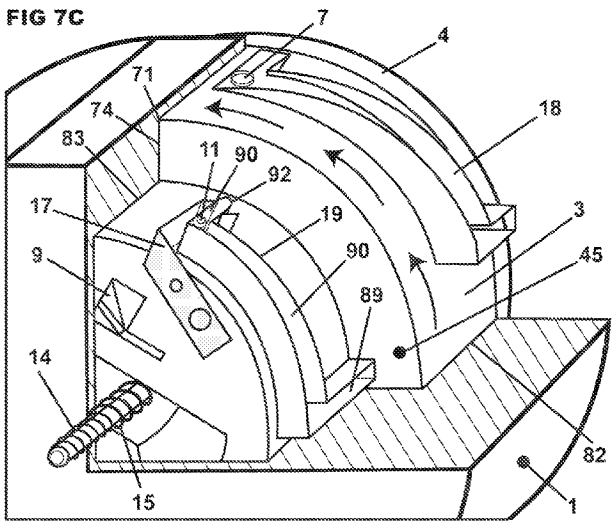
Figure 8C:
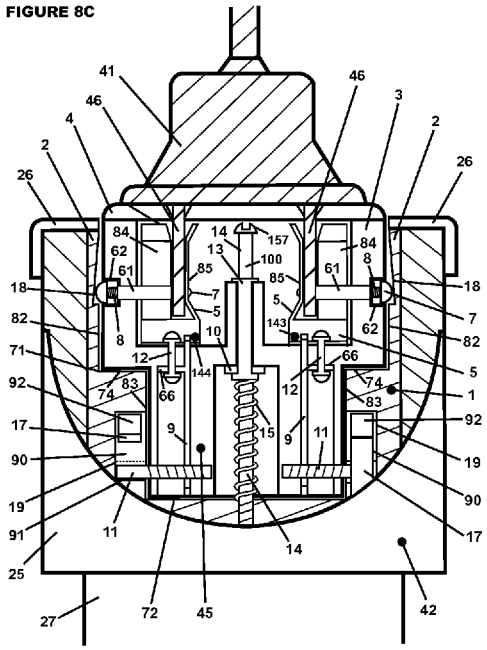

FIGS. 7C and 8C show the receptacle modules 1 third locking action step in which said receptacle assembly 45 has been turned to its furthest clockwise position by said user. Said male plug 41 is inserted and partially locked within said receptacle assembly 45 by said lock pins 7, said locking electrical contacts 5 are not energized.

Said retaining screw 14 allows said receptacle assembly 45 to slide and pivot within said receptacle housing cavity 71, said return spring 15 exerts a continuous outward force upon said receptacle assembly 45 and A continuous electrical grounding circuit is formed between; said retaining screw 14, said retaining screw sleeve 13, said ground terminal 10, and said ground prong contact 6 (FIG. 3A, 3B). Said ground prong contact 6 accepts said plug's ground prong 47 (FIG. 1).

In this position the depth of said engagement ramps 18 recessed area has progressively decreased as said receptacle assembly 45 was turned within said receptacle housing cavity 71 by said user. Said lock pins 7 are now positioned within the shallow recessed area of said engagement ramps 18, which has thus urged said lock pins 7 to slide inward through said locking contact outer terminal channels 61. As said lock pins 7 are urged inward said lock pin head 88 fits within said lock pin hole recessed areas 62 while said lock pins shafts 87 engage through said plug's prong holes 48 (FIG. 1), and engage through said inner contact terminal hole 86 (FIG. 3A, 3B) which effectively locks said plug 41 within said receptacle assembly 45.

Said guide pins 11 are electrically isolated and have traveled clockwise through said channel-way horizontal slots 91 as said receptacle assembly 45 was turned by said user. Said guide pins 11 are now positioned where said channel-way horizontal slot 91 and said channel-way short vertical detent slot 90 meet. Said channel-way short vertical detent slot 90 limits the clockwise rotation of said receptacle assembly 45, while allowing said receptacle assembly 45 to travel outward to the final locking action step position (FIG. 7D, 8D).

Figure 8D:
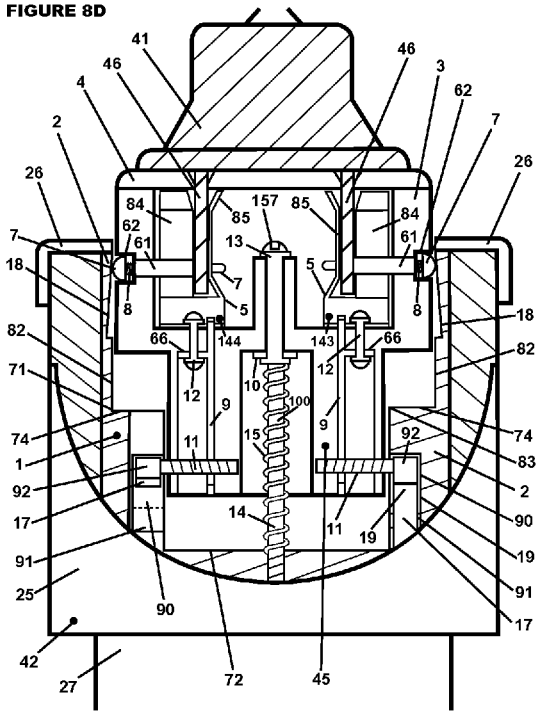

FIGS. 7D and 8D show said receptacle modules 1 final locking action step in which said user has released said plug 41, and said receptacle assembly 45 been urged to its outward locked position by said return spring 15. Said plug 41 is now fully locked within said receptacle assembly 45 by said lock pins 7, and said locking electrical contacts 5 are now energized, which thus energizes said plug's terminal prongs 46.

In this step said guide pins 11 are now located in the upper area of said channelway short vertical detent slots 90, and are in physical contact with the energized guide pin contact heads 92, thus forming electrical communication between said guide pin contacts 17 and said guide pins 11. The semicircular shape of said guide pin contact head 92 creates a biasing force to firmly grasp said guide pins 11 to create a secure electrical connection with said guide pins 11, while still allowing for easy disconnection when desired by said user. Said locking electrical contact assemblies 143, 144 form an electrical circuit to energize said locking electrical contacts 5 and thus energize said plug's terminal prongs 46. Said receptacle assembly 45 is prohibited from turning by said guide pins 11 position in the top of said channel-way short vertical detent slot 90 and is held in its outward position by said return spring 15.

As said receptacle assembly 45 traveled upward within said receptacle housing cavity 71 said engagement ramps 18 recessed area has progressively decreased to their shallowest depth, which has thus urged said lock pins 7 to slide inward through said locking contact outer terminal channels 61. As said lock pin shafts 87 are urged inward they engage through said plug's prong holes 48 (FIG. 1) and engage said inner contact terminal hole 86 (FIG. 3A, 3B), which effectively locks said plug 41 within said receptacle assembly 45. Said lock pin heads 88 fit within said lock pin holes recessed areas 62.

A continuous grounding circuit is formed between; said retaining screw 14, said retaining screw sleeve 13, said ground terminal 10, and said ground prong contact 6 (FIG. 3A, 3B). Said ground prong contact 6 accepts said plug's ground prong 47 (FIG. 1).

Additional Embodiments

Figure 9A:
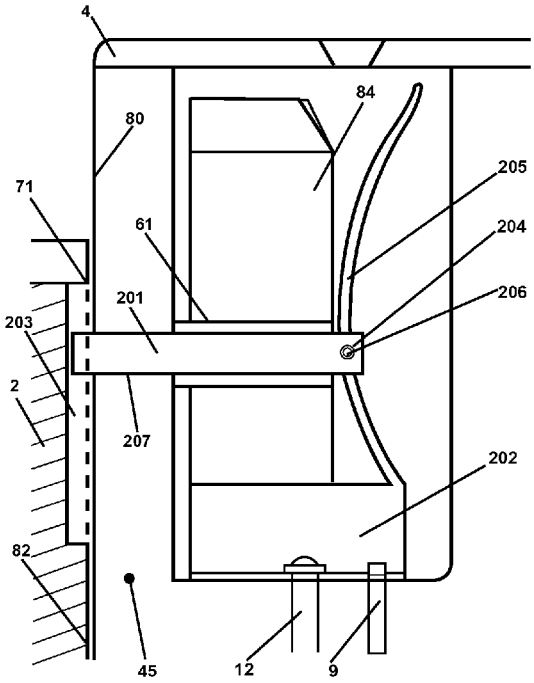
FIGS. 9A and 9B are partial cutaway views of the extension cord outlet showing the action of an alternative embodiment of the outlet.
Figure 9B:
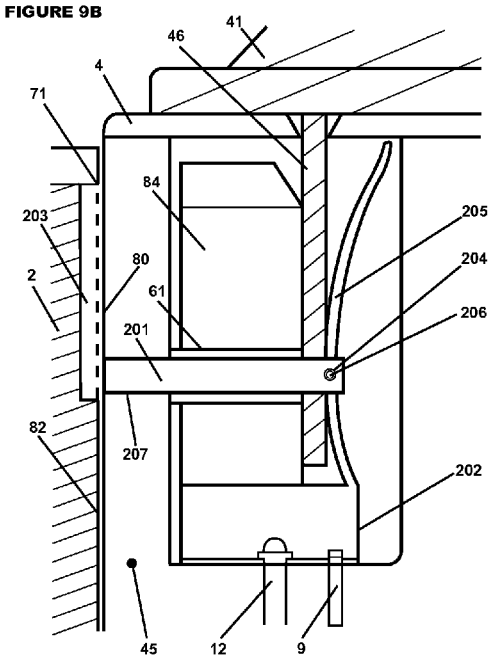

FIGS. 9A and 9B

Description of Additional Embodiments

Additional embodiments are shown in FIGS. 9A and 9B in which said receptacle assembly 45 of the preferred embodiment is prohibited from rotating from its unenergized idle position within said receptacle housing cavity 71 of the preferred embodiment, by a pair of sliding rods 201 which are slidably carried by said receptacle assembly 45. Said sliding rods 201 cooperate with a pair of position holding locking electrical contacts 202 and extend outward from said receptacle body forward section 80 outer periphery to engage a pair of corresponding elongated vertical locking channels 203 defined into said cavity upper chamber 82 inner periphery.

Said sliding rods 201 are formed from a suitable rigid non conductive material, and define a tubular shape having a hole 204 defined near one end.

Said position holding locking electrical contacts 202 take the form of said locking electrical contacts 5 from the preferred embodiment, and also have a semicircular shaped inner contact terminal 205. Said inner contact terminal 205 defines a sideways protruding barb 206 which said sliding rod hole 204 accepts. When not engaged by said plug's terminal prongs 46 the semi circular shape of said inner contact terminal 205 biases said sliding rods 201 outward through a rod channel 207 defined into said receptacle body upper section 80 outer periphery. Said sliding rods 201 protrude into said locking channels 203 to thus prohibit said receptacle assembly 45 from rotating. Said lock pin 7 and said engagement ramps are not shown so as to better illustrate this feature.

Operation of Additional Embodiments

As seen in FIG. 9A, the extended sliding rods 201 cooperate with said locking channels 203 to prohibit said receptacle assembly 45 from rotating from its un-energized idle position until the cooperating locking electrical contacts 202 have received said plug's terminal prongs 46.

To rotate said receptacle assembly 45 said user simply inserts said plug 41 into said receptacle assembly 45, as seen in FIG. 9B. As said locking electrical contacts 202 receive said plug's terminal prongs 46 said inner contact terminals 205 are biased inward which drafts said sliding rods 201 to disengage from said locking channels 203, thus allowing said receptacle assembly 45 to rotate relative to said housing 2.

This feature helps to prohibit an unwitting child from rotating said receptacle assembly 45 to the energized position by requiring both locking electrical contacts 202 to have received said plug's terminal prongs 46 to allow rotation. By remaining unenergized said receptacle module 1 helps prevent shocking to a curious child who may insert a metallic object into said receptacle assembly 45.

Alternative Embodiments

Figure 10A:
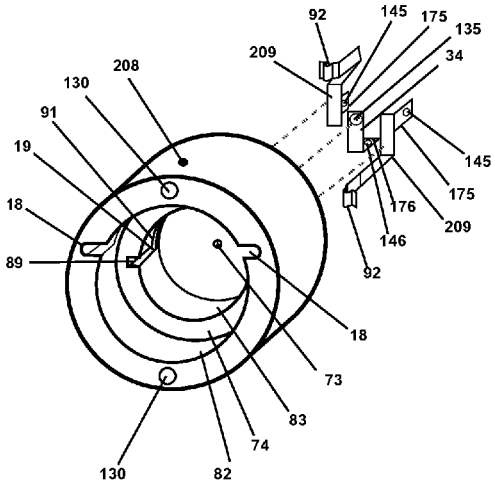
FIG. 10A is a perspective view of an alternative embodiment of the outlet.
Figure 10B:
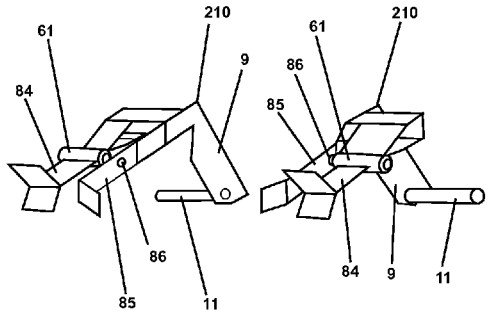
FIG. 10B is a perspective view of an alternative locking electrical contact assembly.

FIGS. 10A and 10B

Description of the Alternative Embodiments

FIG. 10A shows that the preferred embodiment of said extension cord outlet housing 42 may incorporate the design and features of the preferred embodiment of said receptacle housing 2, to define an alternative outlet housing 208.

The design and features of the preferred embodiment of said guide pin contacts 17, and the design and features of the preferred embodiment of said extension cord outlet terminals 33 may be incorporated together to form an alternative guide pin contact 209.

Additionally, it should be understood that the housings of other outlet arrangements may incorporate the design and features of said receptacle housing 2 of the preferred embodiment to form alternative housings.

As seen in FIG. 10B, the design and features of the preferred embodiment of said locking electrical contact assemblies 143, 144 components may be incorporated together to form an alternative locking electrical contact assembly 210.

Operation of the Alternative Embodiments

The alternative embodiments do not affect the operation or functions of the invention. To operate the invention said user performs or reverses the same locking action steps of the outlet of the preferred embodiment.

Advantages

From the description above, a number of advantages of our protective lockable female electrical outlet become evident:

(a) the locking electrical contacts and the cooperating slidable lock pins provide a secure and constant electrical connection between a male plug and the outlet when locked, so as to decrease the possibility of unwanted accidental plug removal.

(b) the outlets channel-ways, guide pins, and return spring cooperate together to provide a method which holds the receptacle assembly in its locked position so that a simple inadvertent twist of the plug's cord will not release the outlet from its locked position, yet is still easily releasable when desired by the user by reversing the lock action steps.

(c) the locking action to secure the plug within the outlet imparts minimal stress to the outlet and the plug due in part to the ease in which the engagement ramps urge the lock pins through the plug's prong holes.

(d) the locking method to secure the plug within the outlet imparts minimal stress upon the outlet and upon the plug during retention because the outlet only needs to hold the lock pins inward through the plug's prong holes, rather than exerting a constant clamping force upon the plug's prongs which may cause extra stress.

(e) the outlet is un-energized when idle to lessen the possibility of electrical shock to a child who may unwittingly insert a metallic object into the outlet, or to a user who may unknowingly touch the plug's terminal prongs during insertion.

(f) the outlets locking steps simultaneously energizes the outlet and secures the plug within to offer a simple, user friendly method of securing and energizing a plug, the locking action steps are easily reversed when desired by the user to disconnect the plug.

(g) the locking electrical contacts, sliding rods, and locking channels cooperate to offer a means for the outlet to hold in its un-energized idle position until the locking electrical contacts have received the plug's terminal prongs, so as to lessen the possibility of shock to the user or a curious child.

(h) the stepped design of the movable receptacle assembly and of the cavity in which it resides offers a means to block an unwitting child from inserting a foreign metal object into the space between the between receptacle assemblies outer periphery and the inner periphery of its cavity, so that the receptacle assemblies power source is not easily accessible to the child.

(i) the outlets locking action steps give full control to the user whether he or she desires the electrical receptacle to have live current available at a specific time, and to remain in that position when initiated properly by an electrical plug.

(j) the modularized form of the receptacle module allows for easy adaptation to form various outlet configurations such as a wall outlet, or an extension cord outlet.

CONCLUSION, RAMIFICATIONS, AND SCOPE

Accordingly, the reader will see that the protective lockable female electrical outlet of this invention can be used to provide a secure and constant electrical connection between a male plug and the outlet, and can hold its locked position despite an inadvertent tug or twist of the cord. The method to secure and retain the plug can impart minimal stress to the outlet and to the male plug so as to not substantially decrease the durability of either. The reader will also see that the outlet can lessen the shocking hazard to a user or unwitting child alike by remaining un-energized when idle, and can prohibit movement from its idle position until the outlet has received the plug terminal prongs. The shape of the receptacle assembly and its corresponding cavity can help to block an unwitting child from contacting the outlets power source with a metallic object such as a bobby pin, and can still make the power source available to the movable receptacle assembly when moved to its locked position by the user. The outlets locking action steps can give full control to the user whether he or she desires the electrical receptacle to have live current available, and can secure and energize the plug simultaneously during the locking action steps in a user friendly manner. The reader will also see that the modularized design of the receptacle module can provide an easily adaptable means to fit and form various arrangements such as a wall outlet or an extension cord outlet.

Furthermore the protective lockable female electrical outlet has the additional advantage that it can easily replace conventional means of adjoining a male plug to an electrical power source regardless of voltage or amperage requirement or plug's terminal configuration.

Although the description above contains many specificities, these should not be construed as limiting the scope of the invention but as merely providing illustrations of some of the presently preferred embodiments of this invention. For example the outlet housing can be shaped as a cylinder, a box, etc. and the means of securing the power supply source wiring to the terminals may also vary to employ other common means to secure the wiring, etc.

Thus the scope of the invention should be determined by the appended claims and their legal equivalents, rather than by the examples given.

We claim:

1. A protective lockable female electrical outlet suitable for use with a standard male electrical plug having a pair of conductive blade type terminal prongs and said prongs each having a plug prong hole proximate to the end of a broad side of said prong, said plug also having a ground prong, said electrical outlet comprising;

a receptacle module, comprising a receptacle body and a receptacle housing;

the receptacle body comprising a line power locking electrical contact assembly and a neutral locking electrical contact assembly; each locking contact assembly comprising at least two prong contact terminals for making electrical communication with the terminal prongs of the male electrical plug, each prong contact terminals comprising an outer prong contact terminal having a channel defined at a proximate location to correspond with the plug prong hole;

an inner prong contact terminal;

a guide pin in electrical communication with said prong contact terminals;

a lock pin, being slidably carried through the outer prong contact terminal channel for engaging said plug prong hole.

2. The female electrical outlet of claim 1, wherein at least one of said prong contact terminals comprises a means for engaging said receptacle housing to thus prohibit said receptacle body from rotating relative to said receptacle housing until said prong contact terminal has received said plug terminal prong.

3. The invention of claim 1, further comprising:

a biasing member to urge said lock pin to a predetermined outward position in which said lock pin does not engage said plug prong hole.

4. The invention of claim 3, wherein:

the biasing member selectively urges the lock pin to engage the plugs prong hole.

5. The invention of claim 3, further comprising:

a ground contact assembly carried by said receptacle body, said ground contact assembly comprising a conductive ground prong contact for making electrical ground communication with the plug ground prong.

6. The invention of claim 5, further comprising:

a conductive retaining element to form a movable continuous electrical ground communication between said ground prong contact and an electrical ground source.

7. The invention of claim 5, wherein:

the receptacle housing has a mechanism for biasing the receptacle body to hold the predetermined outward positions relative to the receptacle housing until said user performs a series of locking or unlocking action steps.

8. The invention of claim 1, wherein:

the inner prong contact terminal has a hole defined at a proximate location to correspond with the plug prong hole;

the lock pin engaging the inner prong contact terminal hole when said receptacle body has been moved to a predetermined position relative to said receptacle housing by the user.

9. A protective lockable female electrical outlet suitable for use with a standard male electrical plug having a pair of conductive blade type terminal prongs and said prongs defining a hole proximate the end of a broad side of said prong, said plug also having a ground prong, said electrical outlet comprising;

(A) a receptacle module, for receiving the plugs prongs, said receptacle module formed from a receptacle assembly being fastened to a receptacle housing, said receptacle assembly comprising;

(a) an insulating receptacle body, having a cylindrical forward section joined to a cylindrical rear section, the receptacle body forward section having an outer periphery corresponding to a first circumference, the receptacle body rear section having an outer periphery corresponding to a second circumference, wherein the first circumference is different than the second circumference;

(b) an insulating cylindrical receptacle cap, carried by said receptacle body, said cap having a front surface, said front surface having a pair of slots defined for accepting the plug terminal prongs, said front surface also having a hole defined for accepting the plug ground prong;

(c) a line power locking electrical contact assembly and a neutral locking electrical contact assembly, each of the locking contact assemblies carried by said receptacle body, each said locking contact assemblies comprising;

(I) at least two conductive prong contact terminals, for making electrical communication with the corresponding said plug terminal prong, said prong contact terminals comprising;

(i) an outer prong contact terminal, having a channel defined at a proximate location to correspond with the plug prong hole;

(ii) an inner prong contact terminal;

(II) a conductive guide pin, in electrical communication with said prong contact terminals, said guide pin protrudes from the receptacle body rear section outer periphery;

(d) a conductive ground contact assembly, carried by said receptacle body, said ground contact assembly comprising;

(I) a conductive ground prong contact, for making electrical ground communication with said plug ground prong;

(II) a conductive retaining screw sleeve, being in electrical communication with said ground prong contact, said sleeve located within said receptacle body;

(e) a lock pin, being slidably carried through the outer prong contact terminal channel, for engaging said plug prong hole when said receptacle assembly has been moved to a predetermined position relative to said receptacle housing by the user;

(f) a biasing member to urge said lock pin to a predetermined outward position in which said lock pin does not engage said plug prong hole;

(B) an insulating receptacle housing, for receiving said receptacle assembly, said receptacle assembly being movable within said receptacle housing, said receptacle housing comprising;

(a) a substantially cylindrical cavity, for receiving said receptacle assembly, said cavity comprising;

(I) an upper chamber, having an inner periphery, the upper chamber inner periphery being of approximate commensurate size of said receptacle body forward section outer periphery, said upper chamber having a floor surface defined at its base;

(II) at least one engagement ramp, defined into said upper chamber inner periphery, said engagement ramp decrease in depth for urging said lock pin to engage said plug prong hole when said receptacle assembly is turned relative to said receptacle housing, by said user;

(III) a rear chamber, centrally defined into the upper chamber floor, said rear chamber having an inner periphery, the rear chamber inner periphery being of approximate commensurate size of said receptacle body rear section outer periphery, said rear chamber having a floor surface defined at its base, the rear chamber floor having a centrally located screw hole defined;

(IV) a first channelway, defined within said rear chamber inner periphery, said first channelway having a pair of separate vertical detent slots having a base, both of the first channelway vertical detent slot bases being joined together by an interposed horizontal slot, said first channelway cooperates with the line power guide pin to limit said receptacle assemblies travel within said receptacle housing;

(V) a second channelway, defined within said rear chamber inner periphery, said second channelway having a pair of separate vertical detent slots having a base, both of the second channelway vertical detent slot bases being joined together by an interposed horizontal slot, said second channelway cooperates with the neutral guide pin to limit said receptacle assemblies travel within said receptacle housing;

(b) a conductive line power guide pin contact, disposed in said first channelway for engaging the line power guide pin when said receptacle assembly has been moved to a predetermined position relative to said receptacle housing by said user, said line power guide pin contact being in electrical communication with an electrical line power source;

(c) a conductive neutral guide pin contact, disposed in said second channelway for engaging the neutral guide pin when said receptacle assembly has been moved to a predetermined position relative to said receptacle housing by said user, said neutral guide pin contact being in electrical communication with an electrical neutral power source;

(C) a conductive retaining screw, having a shaft and having a head, the retaining screw shaft slidably passes through said retaining screw sleeve, said retaining screw being in continuous electrical ground communication with said sleeve, said retaining screw shaft being fixably mounted through the rear chamber floor surface screw hole, the retaining screw head limits the outward travel of said sleeve and thus limits the outward travel of said receptacle assembly;

(D) a spring, disposed between said rear chamber floor surface and said receptacle body rear section, whereby said receptacle assembly is biased upward relative to said receptacle housing when said receptacle assembly is rotated to predetermined positions by said user, said spring also holds said receptacle assembly in the predetermined upward position;

(E) an insulating outlet housing, comprising;

(a) at least one cavity for receiving said receptacle module;

(b) a conductive line power outlet terminal, being in electrical communication with said line power guide pin contact, said line power outlet terminal having a means to form electrical communication with said electrical line power source;

(c) a conductive neutral outlet terminal, being in electrical communication with said neutral guide pin contact, said neutral outlet terminal having a means to form electrical communication with said electrical neutral power source;

(d) a conductive outlet ground terminal or a conductive mounting bracket, in electrical ground communication with said retaining screw, said outlet ground terminal or said mounting bracket having a means to receive the power supply ground source;

(e) an insulating cover or an insulating cap, to enclose said receptacle module within said cavity, said cover or said cap having at least a hole through which said receptacle assembly protrudes.

10. A female electrical outlet capable of receiving a standard male electrical plug in which the male electrical plug has a pair of conductive prongs wherein each conductive prong has a hole, the female electrical outlet comprising:

a receptacle assembly;

the receptacle assembly comprising a receptacle body;

the receptacle body having a forward section and a rear section;

the rear section having an outer periphery corresponding to a first circumference; the forward section having an outer periphery corresponding to a second circumference;

the first circumference different than the second circumference;

a conductive line locking electrical contact assembly;

a conductive neutral locking electrical contact assembly;

the conductive line locking electrical contact assembly having at least two prong contact terminals for making electrical communication with the plug terminal prongs;

each prong contact terminal having a channel to correspond with the plug prong hole;

the conductive neutral locking electrical contact assembly having at least two prong contact terminals for making electrical communication with the plug terminal prongs;

each prong contact terminal having a channel to correspond with the plug prong hole;

a lock pin for engaging at least one of the plug prong holes when the receptacle assembly is in a first position whereby the male electrical plug cannot be removed from the female electrical outlet.

11. The invention of claim 10, further comprising:

a mechanism to bias the lock pin in an outward position wherein the lock pin is prevented from engaging at least one of the plug prong holes when the receptacle assembly is in a second position whereby the male electrical plug can be removed from the female electrical outlet.

12. The invention of claim 11, further comprising:

an outlet housing for receiving the receptacle assembly;

the receptacle assembly rotatable within the outlet;

the outlet housing having a mechanism for biasing the lock pins to engage the plug prong hole when the receptacle assembly is in the first position.

13. The invention of claim 12, further comprising:

a conductive ground contact assembly having a conductive ground prong contact for making ground electrical communication with the plug ground prong.

14. The invention of claim 13, further comprising:

a receptacle cap for receiving the plug terminal prongs and for receiving the plug ground prong.

15. The invention of claim 14, further comprising:

an outer prong contact terminal;

an inner prong contact terminal.

* * * * *